United States Patent [19]

Pringle

[11] 3,975,783

[45] Aug. 24, 1976

[54] SOFA BED

[75] Inventor: William L. Pringle, Grosse Pointe Shores, Mich.

[73] Assignee: United States Steel Corporation, Pittsburgh, Pa.

[22] Filed: June 10, 1975

[21] Appl. No.: 585,684

[52] U.S. Cl. ..... 5/18 R; 5/13; 5/29

[51] Int. Cl.[2] ..... A47C 17/14

[58] Field of Search ..... 5/13, 17, 18, 28 T, 5/29 R, 41, 47, 48

[56] References Cited

UNITED STATES PATENTS

| | | | |
|---|---|---|---|
| 1,295,840 | 3/1919 | Bartlett | 5/13 |
| 3,165,757 | 1/1965 | Rogers | 5/13 |
| 3,747,135 | 7/1973 | Barabas | 5/13 |

*Primary Examiner*—Casmir A. Nunberg
*Attorney, Agent, or Firm*—McGlynn and Milton

[57] ABSTRACT

A furniture assembly such as a sofa bed which moves between a sitting configuration and a bed configuration including a metal support frame having end units with interconnecting beam members removably connected to the end units by bolts. A metal plate is secured to each end unit and includes a pair of slots inclined or slanted upwardly and forwardly from the rearward ends with U-shaped metal track members having flanges secured to the metal plates for defining laterally extending track surfaces. Inner and outer frames are pivotally connected together by an intermediate frame and are movable between a folded position and an unfolded position to define the bed configuration. The inner frame has bifurcated brackets secured thereto and shafts are connected to the bifurcated brackets and extend through the slots in the adjacent plates to support rollers which roll along the track members. The shafts have threaded nuts thereon and the shafts are the sole means for supporting the bed frames on the support frame. A leg member is pivotally connected to the intermediate frame and includes gear teeth disposed about the pivotal connection to the intermediate frame to coact with gear teeth on the inner frame whereby the leg member is moved to a leg supporting position upon relative pivotal movement between the intermediate frame and the inner frame. A handle-leg unit is pivotally connected to the outer frame and includes first and second links pivotally connected together whereby the links may be moved from a collapsed stored position to an extended position for supporting the outer frame when in the bed configuration. A pin and an L-shaped slot interconnect the links for locking the links against relative pivotal movement. A catch or pin is disposed on the inner frame for coaction with the slot in one of the links whereby that link positions the inner and outer frames relative to one another when in the folded position and to selectively prevent the outer frame from being pivoted toward the unfolded position from the folded position.

25 Claims, 7 Drawing Figures

SOFA BED

The subject invention relates to a furniture assembly of the type utilized as a sofa bed for movement between a sitting configuration and a bed configuration.

Such assemblies typically include a wooden support frame for movably supporting a foldable bed frame assembly wherein the bed frame assembly is movable from a folded position in which it defines the seating configuration to a completely unfolded position where it defines the bed configuration. Normally, the connection between the foldable bed frame assembly and the support frame means includes a plurality of the links and/or levers which are pivotally connected between the support frame and the bed frame. Such links and levers occupy a significant amount of space laterally between the bed frame assembly and the support frame. In addition, it is difficult and cumbersome to assemble a bed frame assembly to a support frame assembly through such links and levers. Such links and levers are frequently utilized in the prior art assemblies to move leg members from a folded position to extended positions for supporting the bed frame assembly in the unfolded position defining the bed configuration. In some instances, tracks have been utilized for interconnecting the foldable bed assembly and the support frame to guide movement of the bed frame assembly relative to the support frame. However, the configuration of the guide tracks utilized in the prior art assemblies make it difficult for the bed frame assembly to be disposed in operative and assembled relationship with the support frame. An example of one such prior art furniture assembly utilizing a track is shown in U.S. Pat. No. 1,078,044 to Samuel Goldstein.

The subject invention overcomes the problems associated with the prior art assemblies by providing a simplified furniture assembly construction which may be utilized as a sofa bed. In accordance with the subject invention, the foldable bed frame assembly is supported by the support frame solely through a unique track means defined by a pair of plates having slots therein and track members secured to the plates and extending along or continuous with the slots in the plates for rotatably supporting rollers which are, in turn, rotatably supported on shafts which are removably connected to the foldable bed frame assembly. The shafts are connected to the foldable bed frame assembly through bifurcated brackets whereby the foldable bed frame assembly is easily connected to and removed from the shafts whereby the foldable bed frame assembly is easily assembled in operative relationship with the support frame. Additionally, the assembly of the subject invention employes a unique support leg member which is moved between a folded or stored position and a support position for supporting the unfolded bed frame assembly by gear teeth interconnecting the leg member and one of the frame members of the foldable bed frame assembly. Further, a novel handle-leg unit is operatively associated with the foldable bed frame assembly for providing a handle to unfold the foldable bed frame assembly and to define a support leg for supporting the foldable bed frame assembly when in the unfolded position defining the bed configuration. The handle-leg also interconnects the frame members of the foldable bed assembly for preventing unfolding movement thereof when in the folded position.

Other advantages of the present invention will be readily appreciated as the same becomes better understood by reference to the following detailed description when considered in connection with the accompanying drawings wherein.

Figure 1:
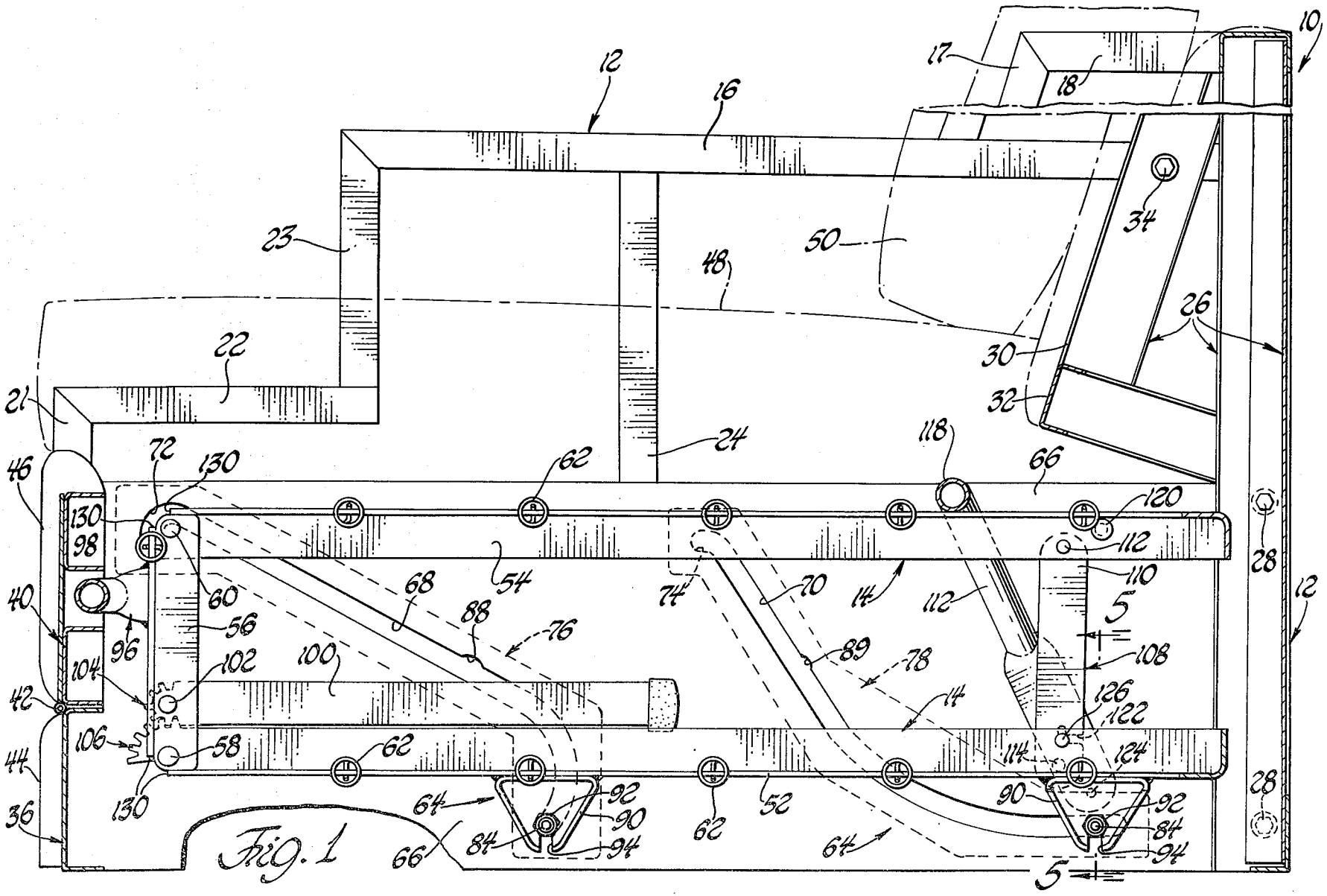
FIG. 1 is a cross-sectional view taken transversely of the length of a furniture assembly constructed in accordance with the subject invention and shows the assembly in the sitting configuration.
Figure 3:
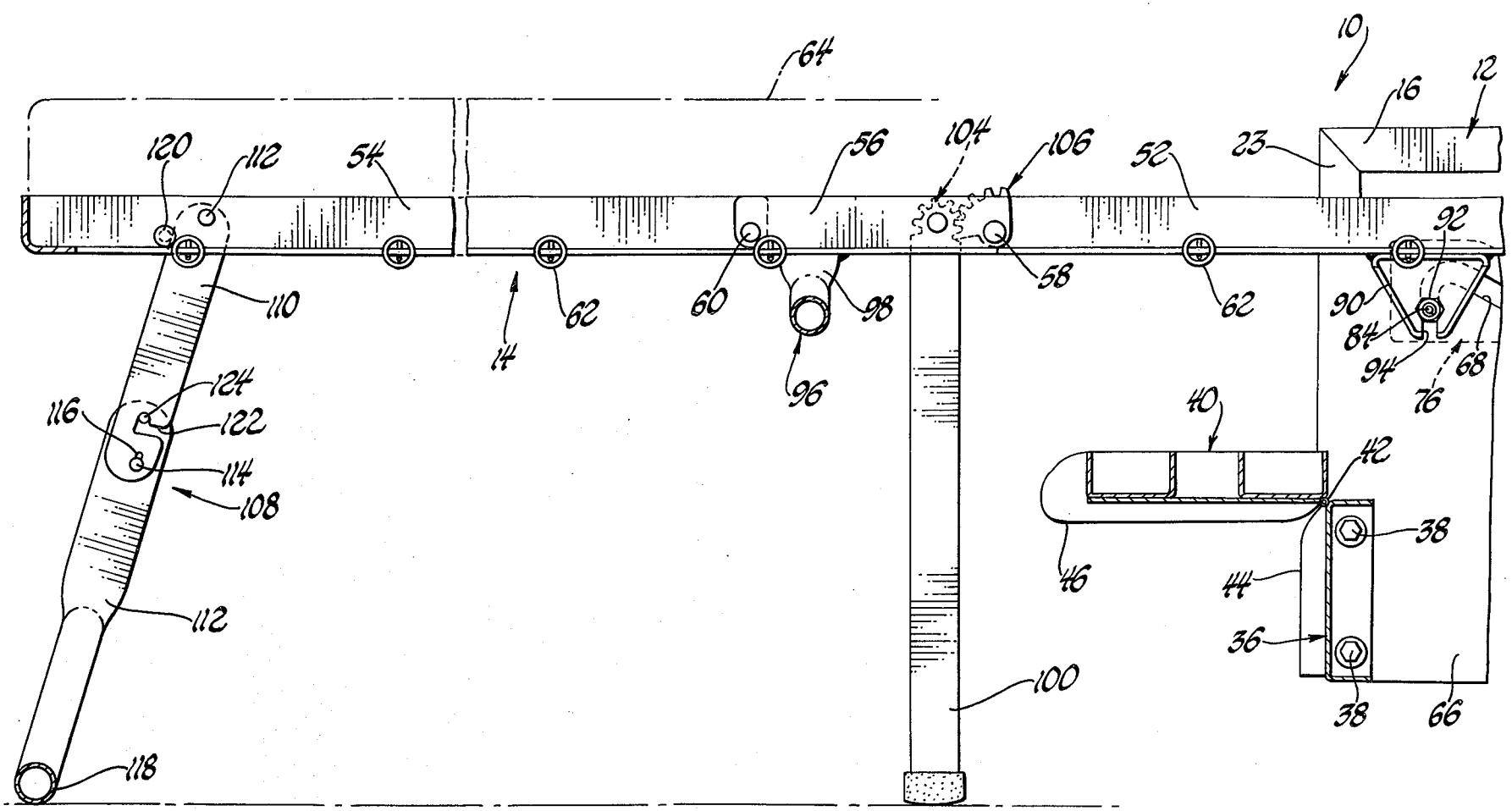
FIG. 3 is a fragmentary cross-sectional view similar to FIG. 2 but showing the assembly in the bed configuration.
Figure 4:
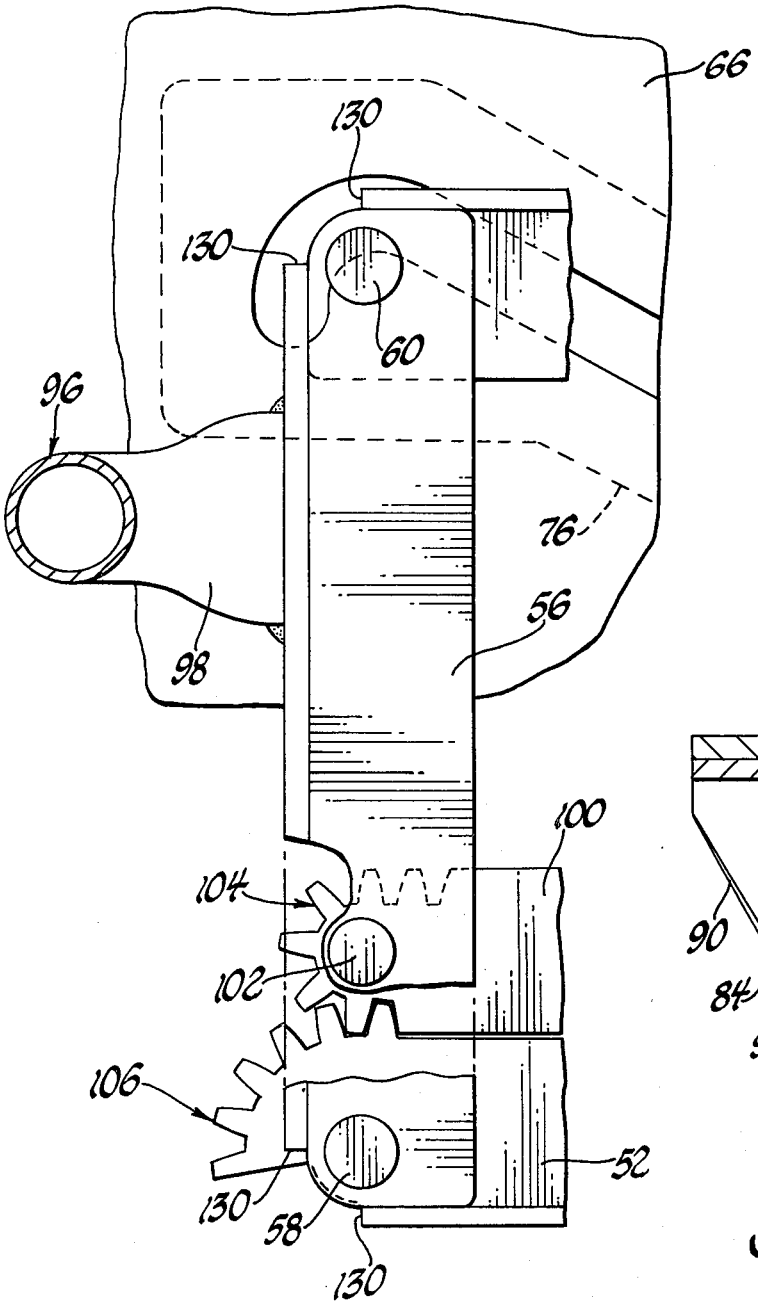
FIG. 4 is a fragmentary cross-sectional view of a portion of the assembly in the position shown in FIG. 1.

A furniture assembly is generally shown at 10 for movement between a sitting configuration shown in FIG. 1 and a bed configuration shown in FIG. 3.

The assembly 10 includes a support frame means generally indicated at 12 for resting upon a support structure such as a floor in a building. The assembly 10 also includes bed frame means generally indicated at 14. The bed frame means 14 is movable between a folded position illustrated in FIG. 1, a completely unfolded position illustrated in FIG. 3. The bed frame means 14 is in the folded position when in a sitting configuration of the assembly shown in FIG. 1 and is in the completely unfolded position when in the bed configuration as shown in FIG. 3.

Figure 6:
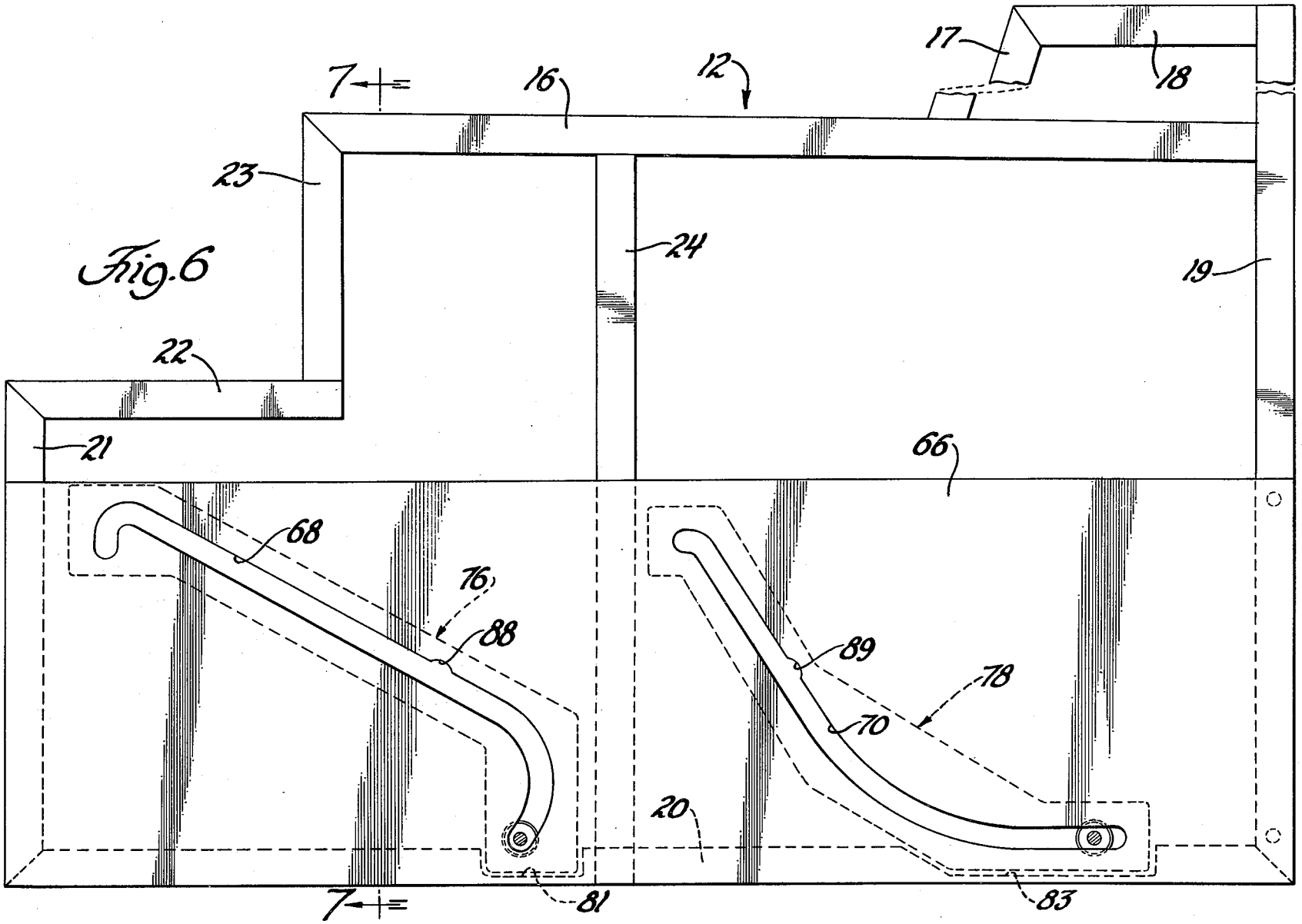
FIG. 6 is a cross-sectional view taken substantially along line 6—6 of FIG. 5 and showing an entire end unit of the furniture assembly of the subject invention.

The support frame means 12 includes a pair of spaced end units, one of which is shown most clearly in FIG. 6. Each end unit includes the channel member 16, 17, 18, 19, 20, 21, 22, 23 and 24. Each of the channel members is generally U-shaped or C-shaped, as viewed in cross section as best seen in regard to the channel members 16, 20 and 22 in FIG. 7. The channel members are made of metal and are welded together to define a structural unit. The channel members 16 and 23 define an arm rest and the channel members 17 and 18 extend upwardly from the arm rest to define an end portion vertically coextensive with the back of the assembly.

Beam units or frames extend transversely between the end units for interconnecting the end units. A back frame or beam unit is generally indicated at 26 in FIG. 1 and includes a laterally extending frame bolted to the end units by the bolts 28 and a back support frame comprising the members 30 and 32 with the members 30 bolted to the channel member 16 of the adjacent end unit by the bolts 34. Another beam unit, generally indicated at 36 interconnects the end units and is connected to the end units by the bolts 38. The beam units extending transversely between the end units are removably connected to the end units by bolts 28, 34 and 38 so that the end units and the beam units may be shipped disassembled to reduce shipping space and assembled to define the support frame means 12 which receives the foldable bed frame means 14. Normally, the assembly 10 is fabricated by one manufacturer and shipped to a second manufacturer for the adding of upholstery, cushions, etc. to define the final product. It will be appreciated that if the support frame means 12 were made of wood it must be completely assembled at the original manufacturer and shipped in the assembled state, thus requiring a significant amount of space much of which is dead shipping space. In contradistinction, the support frame means 12 of the subject assembly may be shipped in a knocked down condition in a relatively compact space and thereafter easily assembled.

Figure 2:
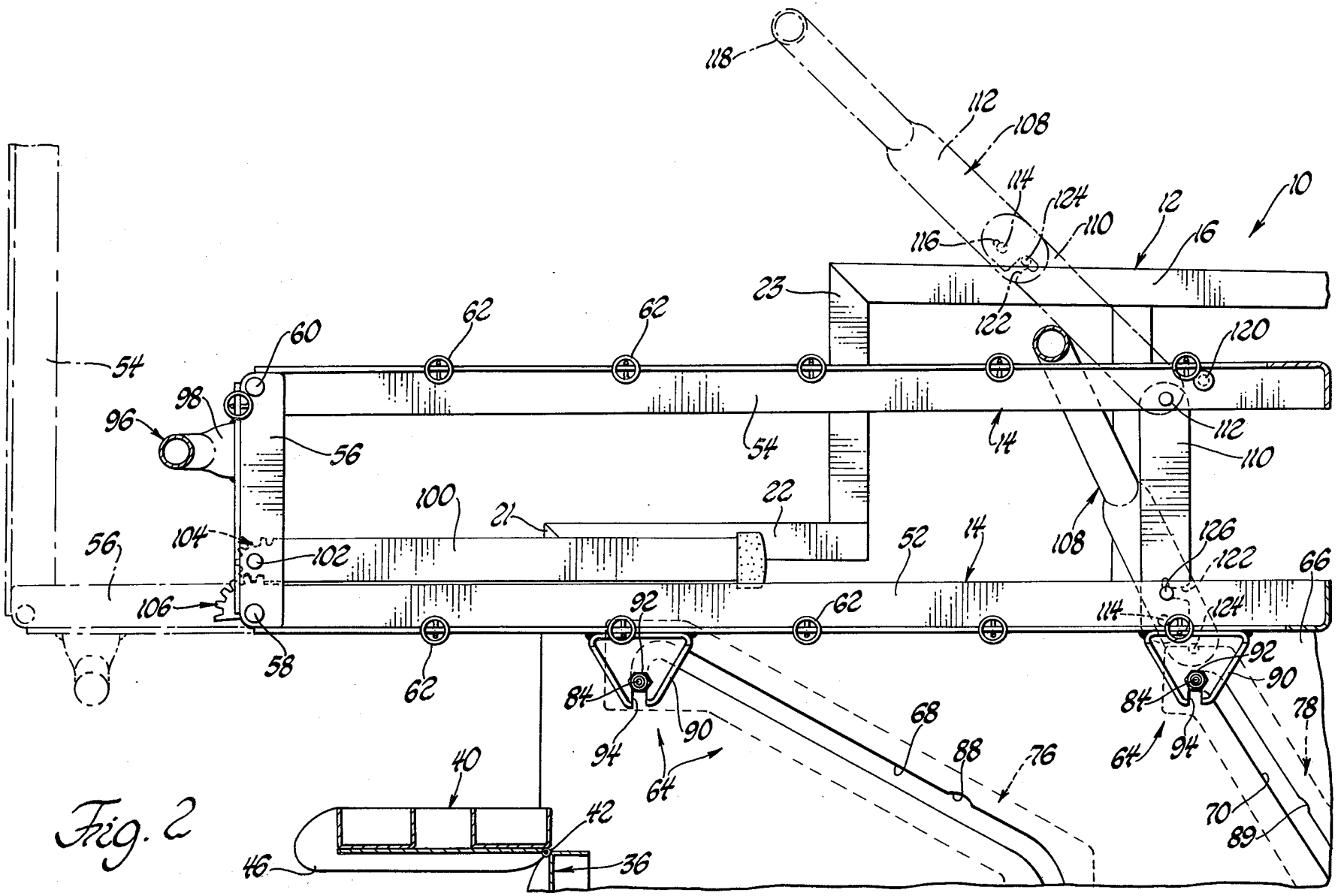
FIG. 2 is a fragmentary cross-sectional view similar to FIG. 1 but showing the furniture assembly in an intermediate position in full lines and an unfolding position in phantom.

A cover panel generally indicated at 40 is hinged at 42 to the top of the beam unit 36 for movement between the covering position shown in FIG. 1 and the open position shown in FIG. 2. When the bed frame means 14 is in the folded stored position, as illustrated in FIG. 1, and the assembly is in the sitting configuration the cover panel 40 is in the covering position shown in FIG. 1. When it is desired to move the bed frame means 14 to the unfolded position to define the bed configuration of FIG. 3, the cover panel 14 is manually moved to the open position shown in FIGS. 2 and 3. An appropriate snap, catch, track, or the like, (not shown) coacts between the cover panel 14 and the support frame means for maintaining the cover panel 14 in the closed position. The beam unit 36 and the cover panel 40 are shown as having decorative upholstery or covering 44 and 46 disposed thereover. It will be understood that the end units and the back beam units 26 will also have such upholstery covering disposed thereon in the finished form.

The bed frame means 14 is normally in the folded stored position where the seat and back cushions shown in phantom at 48 and 50 are in position to define the sitting configuration. The bed frame means 14 includes an inner mattress frame 52, and outer mattress frame 54, and an intermediate frame 56 pivotally interconnecting the inner and outer frames 52 and 54 by the pivot pins 58 and 60. The frames 52, 54 and 56 are generally rectangular in configuration and extend transversely between the end units and are defined by right-angled steel members which are welded together. The frames have coiled springs 62 connected thereto which, in turn, support metal straps, and the like, extending lengthwise of the frame members for supporting a mattress such as that shown in phantom at 64 in FIG. 3, a well known structure utilized in sofa bed assemblies. The outer frame 54 and the intermediate frame 56 are pivotal relative to the inner frame 52 between the folded position shown in FIG. 1 where the outer frame 54 is disposed in spaced parallel relationship above the inner frame 52 and the completely unfolded position shown in FIG. 3 where the inner frame 52, the outer frame 54 and the intermediate frame 56 are substantially co-planar with one another to define the bed configuration.

The assembly 10 also includes a track means generally shown at 64 interconnecting the end units of the support means 12 and the bed frame means 14 for guiding movement of the bed means 14 relative to the support frame means 12 during movement of the bed frame means 14 between the sitting configuration shown in FIG. 1 and an intermediate position shown in FIG. 2, in which intermediate position the bed frame means 14 may be moved between the folded and unfolded positions. The track means 64 includes first and second plates, one of which is shown at 66 secured to each end unit of the support frame means 12. Each plate 66 is made of metal and is welded or it otherwise secured to the channel members 19, 20, 21 and 24 of the end unit of the support frame means 12. Each plate 66 includes first and second elongated slots 68 and 70 therein. The plates 66 are identical to one another and present images of one another when attached to the respective end units so that each of the elongated slots 68 and 67 slant upwardly and forwardly from the rearward extremities thereof. The slot 68 at its upward and forward end includes retaining means defined by a hooked shaped portion 72 which extends downwardly for preventing horizontal movement of the inner frame member 52 when in the bed configuration. The slot 70 at its upward forward end includes a horizontally extending portion 74 defining part of the retaining means for supporting the weight of the inner frame member 52 when in the bed configuration.

Figure 5:
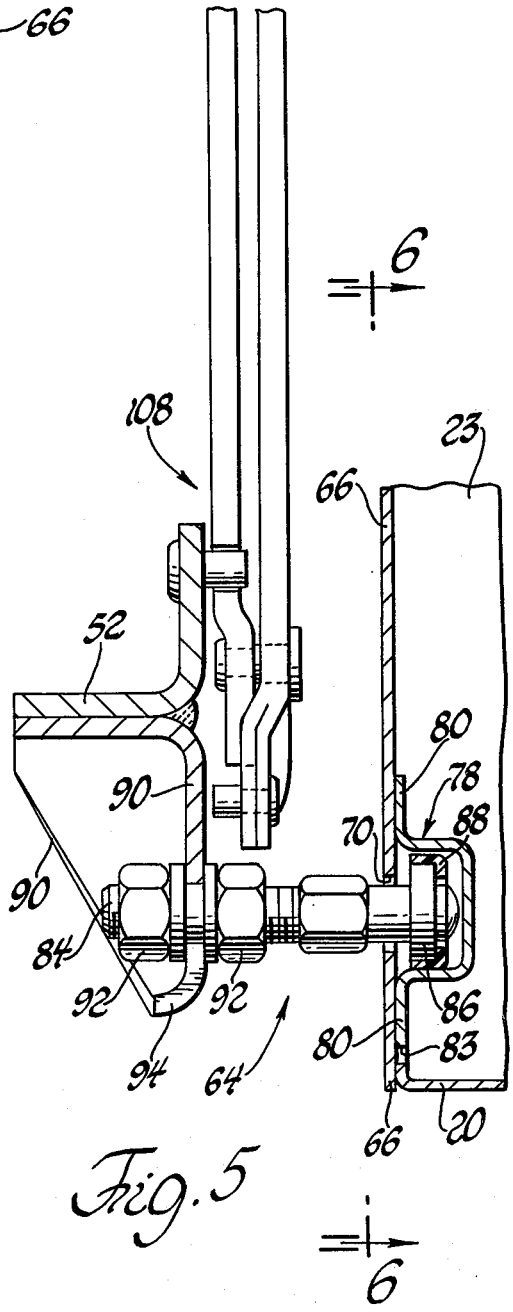
FIG. 5 is a fragmentary cross-sectional view taken substantially along line 5—5 of FIG. 1.
Figure 7:
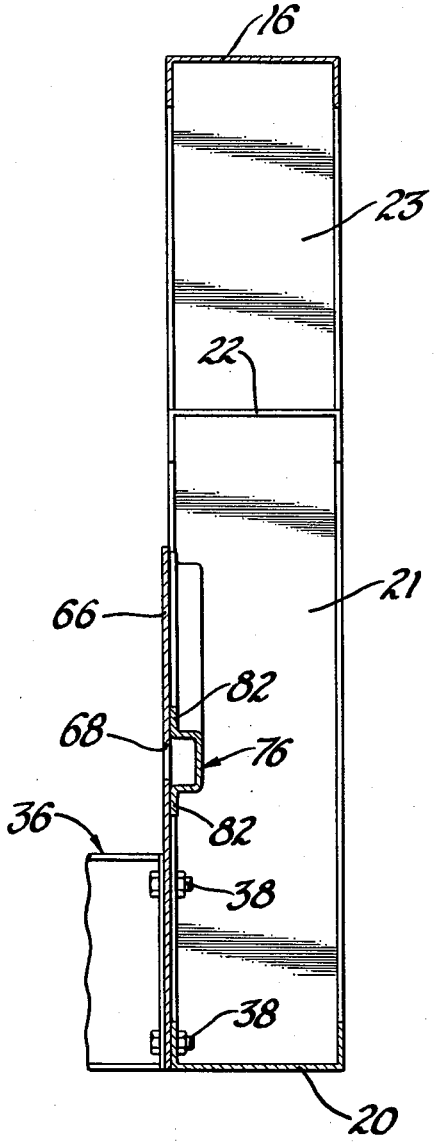
FIG. 7 is a cross-sectional view taken substantially along line 7—7 of FIG. 6.

The track means 64 also includes the track members generally indicated at 76 and 78. Each of the track members are formed by stamping, or the like, of sheet metal and are generally U-shaped in cross section, as best shown in FIGS. 5 and 7, to present a pair of spaced horizontal or laterally extending surfaces with co-planar flanges 80 and 82 extending therefrom and secured to the metal plate 66. The flanges 80 and 82 may be secured to the plate 66 by welding, or the like. The horizontal or laterally extending surfaces of each of the track members 76 and 78 are spaced apart a greater distance than the width of the associated slot 68 and 70 in the associated plate 66. The track members 76 and 78 are closed at each of the ends thereof. The adjacent or inner flanges of the structural elements 20 are recessed as indicated at 81 and 83 for accomodating the lower and rearward ends of the respective track members 76 and 78 so that the end flanges of the track members 76 and 78 may be secured to the adjacent plate 66.

A plurality of shafts 84 are connected to the inner frame 52 and extend through the elongated slots 68 and 70. Each shaft 84 rotatably supports a track roller 86 which is in rolling engagement with the laterally extending surfaces of the track members 76 and 78. Each roller 86 preferably has a plastic or resilient covering 88 thereabout for reducing noise and friction. Each roller 86 has a diameter which is greater than the width of the associated slot 68 or 70 and each slot 68 and 70 has an enlargement 88 and 89 respectively of enlarged width or a width greater than the remainder of each slot 68 and 70 for permitting insertion of the rollers 86 through the slots 68 and 70 while supported on the shafts 84. In other words, the shaft may be disposed at an oblique angle to cock the roller as the roller moves through the enlargement of a slot for disposition within a track member.

A plurality of brackets 90 are welded or otherwise secured to the inner frame member 52 of the bed frame means 14 and each of the shafts 84 is removably connected to one of the brackets 90. More specifically, each of the shafts 84 is threaded at its distal end and fastening means defined by nuts 92 threadedly engage the ends of the shafts 84 for clamping engagement with brackets 90. The shafts 84 are the sole interconnection between the bed frame means 14 and the support frame means 12. Each of the brackets 90 is bifurcated to include an open slot as indicated at 94 to receive one of the shafts 84.

As will be appreciated, the shafts 84 with the rollers 86 thereon may be inserted through the enlargements 88 and 89 of the slots 68 and 70 place the rollers 86 in engagement with the track members 76 and 78 and thereafter the bed frame means 14 may be lowered into place with the bifurcated brackets 90 receiving the shafts 84. Thereafter, the nuts 92 may be tightened to rigidly connect the bed frame means 14 to the support frame means 12 for movement relative thereto a defined by the slots 68 and 70.

Also included is a handle means generally indicated at 96 connected to the intermediate frame 56 for manually moving the inner frame 52 and the entire bed frame means 14 upwardly and forwardly as the track rollers 86 move along the track members 76 and 78 to move the frames 52, 54 and 56 to the intermediate position shown in full lines in FIG. 2 from which it may be moved between the folded and unfolded positions. The handle means 96 comprises a circular shaped bar extending transversely between the opposite ends of the intermediate frame 56 and having flattened end portions 98 turned inwardly or laterally and welded to the lateral extremities of the intermediate frame 56. The circular shaped bar extends perpendicularly to the end units.

The assembly 10 also includes leg members 100 pivotally connected by pins 102 to the end members of the intermediate frame 56 for movement between a collapsed position as shown in FIG. 1 where the frames 52, 54 and 56 are in the folded position and in an extended position shown in FIG. 3 where the frames 52, 54 and 56 are in the unfolded position. Preferably, a leg member 100 is disposed at each of the opposite lateral extremities of the intermediate frame 56 whereby there is a leg member 100 at each end of the bed frame means 14.

Gear means operatively interconnects each leg member 100 and the inner frame 52 for moving the leg members 100 between the collapsed position shown in FIG. 1 and the extended position shown in FIG. 3 in response to relative pivotal movement between the inner frame 52 and the intermediate frame 56. The gear means includes first gear teeth generally indicated at 104 and formed in the end of the leg member 100 and disposed circumferentially on a pitch circle about the axis of rotation of the leg member 100 relative to the intermediate frame 56, which axis is defined by the pins 102. The gear means also includes second gear teeth generally indicated at 106 formed in the outward end of the angled metal members defining the end extremities of the inner frame 52. The gear teeth 106 are disposed on a pitch circle about the axis of pivotal movement between the intermediate frame 56 and the inner frame 52 as defined by the pins 58. The gear teeth 104 are in meshing engagement with the gear teeth 106 for rotating the leg members 100 upon relative pivotal movement between the inner frame 52 and the intermediate frame 56.

Also included is a foldable handle-leg means generally indicated at 108 and pivotally connected to the end members of the outer frame 54 for moving the outer frame 54 and the intermediate frame 56 from the folded position shown in FIG. 2 toward the unfolded position shown in FIG. 3 and for moving to a support position as shown in FIG. 3 to act as a leg to support the outer frame 54 in the unfolded position. The handle-leg means 108 includes a first link 110 pivotally connected at a first end thereof by a pin 112 to the outer frame 54 and extends to a second end. A second link 112 is pivotally connected by a pin 114 and an elongated slot 116 at the inner end thereof to the second end of the first link 110 and extends to a distal end for resting upon a support surface. The elongated slot 116 allows movement of the pin 114 and the second link 112 longitudinally of the first link 110. As will be appreciated, a first link 110 is disposed at each of the opposite extremities or ends of the outer frame member 54 and the second links 112 are defined by a member having a circular or a pipe-like cross section which extends transversely between the ends of the outer frame 54 and has laterally downwardly projecting portions flattened at the inward ends and defining the links 112. Thus, a circular handle bar 118 is an integral part of the second links 112 and extends substantially coextensively with the outer frame 54 for resting upon a support surface such as a floor. The circular bar 118 extends perpendicularly to the end units of the support frame means 12. The first and second links 110 and 112 are movable between a collapsed stored position as shown in FIGS. 1 and 2 in full lines and a support position as shown in FIG. 3. The cross member or bar 118 defines a handle bar integrally interconnecting the distal end of the second links 112. An abutment means comprising the pins 120 supported on the outer frame 54 limit pivotal movement of the first links 110 relative to the outer frame 54 to define the support position shown in FIG. 3.

The handle-leg means 108 includes lock means for selectively preventing relative pivotal movement between the links 110 and 112. More specifically, the lock means includes an L-shaped slot 122 extending into each of the first links 110 laterally from an edge thereof with the long side of the L-shape being perpendicular to that edge and a pin 124 extending from each of the second links 112 for coacting with the L-shaped slots 122 in the associated first link 110.

There is also included a catch means comprising a pin 126 extending from the inner frame 52 for coacting with an L-shaped slot 122 of the lock means when the links 110 and 112 are in the collapsed or stored position for preventing unfolding movement of the outer frame 54 relative to the intermediate and inner frames 56 and 52.

There is also included stop means defined by the shoulders or abutments 130 at the ends of the structural members defining the frames 52, 54 and 56 for limiting relative pivotal movement between those frames in the unfolding direction and at the unfolded position defining the bed configuration.

OPERATION

As explained above, the manufacturer of the furniture assembly 10 may ship the assembly with the end units disconnected from the interconnecting beam units along with the bed frame assembly 14 to a manufacturer who places the appropriate upholstery and covering over the various components of the assembly. Upon receipt, the upholsterer first assembles the support frame means 12 by bolting the beam units to the end units and thereafter he inserts the rollers 86 and associated shafts 84 through the slots 68 and 70. He then places the bed frame means 14 in position by placing the shafts 84 in the bifurcated brackets 90 and tightening the nuts 92 to secure the bed frame means 14 to the support frame means 12.

During the operation, the assembly 10 is in the sitting position shown in FIG. 1 wherein the bed frame means is in the folded position with a mattress folded between the frame members 52 and 54. The outer frame member 54 is prevented from moving upwardly toward the unfolded position as the pins 126 extending from the inner frame member 54 are disposed in the L-shaped slots 122 of the first links 110.

To convert the assembly to the bed configuration, the cover plate 40 is pivotted to the open position shown in FIGS. 2 and 3 and the handle 96 is manually grasped and moved upwardly to move the forward rollers 86 upwardly in the forward track member 76. Thereafter, the handle 96 is moved forwardly and upwardly to move the bed frame assembly 14 forwardly and upwardly to the intermediate position shown in FIG. 2. The forward shafts 84 are disposed in the hooked portions 72 of the slots 68 and the forward track members 76 to retain the bed frame means 14 in the intermediate position shown in FIG. 2. The rear roller members 86 and the associated shafts 84 are disposed in the horizontal portion 74 of the rear track means for supporting vertical weight of the bed frame assembly 14.

When in the position shown in FIG. 2, the handle-leg means 108 is manually grasped by the handle portion 118 to move the first links 110 to disengage the pins 126 from the L-shaped slots 122. The links 110 and 112 are moved to the position shown in phantom in FIG. 2 by moving the pins 124 into the slots 122 and thereafter moving the links 112 longitudinally of the links 110 to place the pins 124 in the short leg portion of the L-shaped slots 122 to prevent relative rotational movement between the links 110 and 112. The longitudinal movement of the links 112 relative to the links 110 is permitted by the elongated slots 116 in the links 110 which define part of the pivotal connection between the links 110 and 112. When the handle-leg means 108 is in the position shown in phantom in FIG. 2, a manual force is applied to the cross member or handle bar 118 to pivot the intermediate frame 56 from the vertical position shown in FIG. 2 to the horizontal position shown in phantom in FIG. 2. During this movement gear teeth 104 and 106 coact to pivot the leg members 100 from the collapsed or stored position shown in full lines in FIG. 2 to the supporting position shown in FIG. 3. Continued movement of the outer frame 54 is thereafter accomplished to move it to a completely unfolded position to define the bed configuration shown in FIG. 3 wherein the links 110 abut the abutments 120 to prevent further pivotal movement and to dispose the handle-leg means 108 in the leg supporting position shown in FIG. 3 for supporting the outer frame 54 in the completely unfolded position.

To move the assembly from the bed configuration shown in FIG. 3 to the sitting configuration shown in FIG. 1, the above operation is reversed and when the assembly is in the position shown in FIG. 2, handle 96 is grasped to raise the forward end of the bed assembly slightly upwardly whereby the forward rollers 86 move down the track members 76 as the rearward rollers and associated shafts move down the rearward tracks 78.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A furniture assembly for movement between a sitting configuration and a bed configuration comprising; support frame means, bed frame means movable between a folded position and an unfolded position, said bed frame means being in said folded position when in said sitting configuration and in said unfolded position when in said bed configuration, track means interconnecting said support frame means and said bed frame means for guiding movement of said bed frame means relative to said support frame means during movement of said bed frame means between said sitting configuration and an intermediate position in which said bed frame means may be moved between said folded and unfolded positions, said track means including a first plate secured to said support frame means, said plate having a first elongated slot therein, a first track member secured to said plate and including at least one laterally extending surface adjacent said slot, a first shaft connected to said bed frame means and extending through said elongated slot, a track roller rotatably supported on said shaft in rolling engagement with said track member, said track member and said slot including retaining means for supporting and selectively preventing movement of said bed frame means in said bed configuration.

2. An assembly as set forth in claim 1 wherein said roller has a diameter greater than the width of said slot, said slot having an enlargement of enlarged width for permitting insertion of said roller through said slot while supported on said shaft.

3. An assembly as set forth in claim 2 wherein said support frame means includes a pair of said end units spaced from one another and beam units interconnecting said end units, said first plate being secured to one of said end units, said first plate including a second elongated slot therein, a second track member secured to said first plate and including at least one laterally extending surface adjacent said second slot, a second plate secured to the other of said end units, said second plate being the mirror image of said first plate to include first and second elongated slots and first and second track members secured thereto to present laterally extending surfaces adjacent said first and second slots, additional track rollers in rolling engagement with each of said additional track members, a shaft rotatably supporting each of said additional track rollers and removably connected to said bed frame means.

4. An assembly as set forth in claim 3 wherein said first and second plates are sheet metal.

5. An assembly as set forth in claim 4 wherein said track members are formed sheet metal.

6. An assembly as set forth in claim 5 wherein said track members are U-shaped in cross section to present a pair of said laterally extending surfaces and include flanges engaging and secured to said plates.

7. An assembly as set forth in claim 6 wherein said end units and said beam units consist of metal structural elements.

8. An assembly as set forth in claim 3 including a plurality of brackets secured to said bed frame means, each of said shafts being connected to said bed frame means by one of said brackets, each of said shafts being removably connected to one of said brackets.

9. An assembly as set forth in claim 8 wherein said shafts are the sole interconnection between said bed frame means and said support frame means.

10. An assembly as set forth in claim 9 wherein each of said brackets is bifurcated to receive one of said shafts, fastening means on each of said shafts for removably connecting each shaft to one of said brackets whereby said bed frame means may be completely connected to and completely disconnected from said support frame means by operating said fastening means and respectively inserting and removing said shafts from said bifurcated brackets.

11. An assembly as set forth in claim 10 wherein said bed frame means includes an inner mattress frame, an outer mattress frame and an intermediate frame pivotally interconnecting said inner and outer mattress frames, said outer frame and said intermediate frame being pivotal relative to said inner frame between said folded position where said outer frame is disposed in spaced relationship above said inner frame and said unfolded position where said inner, outer and intermediate frames are co-planar, said brackets being secured to said inner frame.

12. An assembly as set forth in claim 11 wherein said slots in said plates slant upwardly and forwardly from the rearward extremities thereof and including handle means connected to said intermediate frame for manually moving said frames upwardly and forwardly as said track rollers move along said track members to move said frames to said intermediate position for movement between said folded and unfolded positions.

13. An assembly as set forth in claim 12 wherein said handle means comprises a bar extending transversely between the opposite ends of said intermediate frame.

14. An assembly as set forth in claim 13 including at least one leg member pivotally connected to said intermediate frame for movement between a collapsed position when said frames are in said folded position and an extended position when said frames are in said unfolded position, and gear means operatively interconnecting said leg member and said inner frame for moving said leg member between said collapsed and extended positions in response to relative pivotal movement between said inner frame and said intermediate frame.

15. An assembly as set forth in claim 14 wherein said gear means includes gear teeth in said leg member and disposed circumferentially about the axis of rotation of said leg member relative to said intermediate frame, and gear teeth in said inner frame in meshing engagement with said gear teeth in said leg member.

16. An assembly as set forth in claim 11 including foldable handle-leg means pivotally connected to said outer frame for moving said outer frame and said intermediate frame from said folded position toward said unfolded position and for moving to a support position to act as a leg to support said outer frame in said unfolded position.

17. An assembly as set forth in claim 16 including stop means between said inner frame and said intermediate frame and between said intermediate frame and said outer frame for limiting relative movement between said frames in the unfolding direction at said unfolded position.

18. An assembly as set forth in claim 17 wherein said handle-leg means includes a first link pivotally connected at a first end thereof to said outer frame and extending to a second end, a second link pivotally connected at an inner end thereof to said second end of said first link and extending to a distal end, said first and second links being movable between a collapsed stored position and said support position, and lock means for selectively preventing relative pivotal movement between said links.

19. An assembly as set forth in claim 18 wherein said handle-leg means includes one of each of said first and second links disposed adjacent each end of said outer frame, and a handle bar interconnecting said distal ends of said second links.

20. An assembly as set forth in claim 19 including abutment means for limiting pivotal movement of said first links relative to said outer frame in said support position.

21. An assembly as set forth in claim 20 including catch means on said inner frame for coacting with at least a portion of said lock means when said links are in said collapsed stored position for preventing unfolding movement of said outer frame relative to said intermediate and inner frames.

22. An assembly as set forth in claim 21 wherein said pivotal connection between each of said first links and said second links allows movement of each of said second links longitudinally of said first links, said lock means includes an L-shaped slot extending into each of said first links and a pin extending from each of said second links for coating with said L-shaped slot in the associated first link.

23. An assembly as set forth in claim 1 wherein said bed frame includes an inner mattress frame, an outer mattress frame and an intermediate frame pivotally interconnecting said inner and outer mattress frames, said outer frame and said intermediate frame being pivotal relative to said inner frame between said folded position where said outer frame is disposed in spaced relationship above said inner frame and said unfolded position where said inner, outer and intermediate frames are co-planar, at least one leg member pivotally connected to said intermediate frame for movement between a collapsed position when said frames are in said folded position and an extended position when said frames are in said unfolded position, and means projecting from said inner frame for interfering engagement with said leg member for moving said leg member between said collapsed and extended positions in response to relative pivotal movement between said inner frame and said intermediate frame.

24. A furniture assembly for movement between a sitting configuration and a bed configuration comprising; support frame means, bed frame means movable between a folded position and an unfolded position, said bed frame means being in said folded position when in said sitting configuration and in said unfolded position when in said bed configuration, means interconnecting said bed frame means and said support frame means for allowing movement of said bed frame means relative to said support frame means, said bed frame means including at least first and second mattress frames pivotally connected together for movement between said folded and unfolded positions, at least one leg member pivotally connected to said first frame member for movement between a collapsed position and an extended position, and means projecting from said inner frame and said leg member for interfering engagement for moving said leg member between said collapsed and extended positions in response to relative pivotal movement between said inner frame and said intermediate frame.

25. An assembly as set forth in claim 24 wherein said means includes gear teeth in said leg member, said gear teeth being disposed circumferentially about the axis of rotation of said leg member relative to said first frame, and gear teeth in said second frame in meshing engagement with said gear teeth in said leg member.

* * * * *